US006279863B1

(12) United States Patent
Hall

(10) Patent No.: US 6,279,863 B1
(45) Date of Patent: Aug. 28, 2001

(54) REMOVABLE BLIND HANGER BRACKETS

(76) Inventor: Richard D. Hall, 4498 Buford Hwy., Apt. 143, Norcross, GA (US) 30071

( * ) Notice: Subject to any disclaimer, the term of this patent is extended or adjusted under 35 U.S.C. 154(b) by 0 days.

(21) Appl. No.: 09/599,841

(22) Filed: Jun. 22, 2000

(51) Int. Cl.[7] ..... E06B 9/323; A47H 1/14
(52) U.S. Cl. ..... 248/264; 160/902
(58) Field of Search ..... 248/261, 262, 248/264, 266, 267, 268, 252, 300, 222.41, 225.11; 211/105.1, 180; D8/366, 371, 380, 381; 160/178.1, 902

(56) References Cited

U.S. PATENT DOCUMENTS

| | | | | |
|---|---|---|---|---|
| 763,486 | * | 6/1904 | Heinrich | 248/267 |
| 1,133,360 | * | 3/1915 | Casper | 248/268 |
| 1,814,422 | * | 7/1931 | Warnick | 160/38 |
| 2,896,900 | * | 7/1959 | Fiedler | 248/262 |
| 4,265,423 | * | 5/1981 | Vecchiarelli | 248/264 |
| 4,580,753 | * | 4/1986 | Hennequin | 248/264 |
| 5,230,493 | * | 7/1993 | Luoto | 248/251 |
| 5,522,444 | * | 6/1996 | Liu | 160/178 |

* cited by examiner

*Primary Examiner*—Anita King
*Assistant Examiner*—Jon A Szumny
(74) *Attorney, Agent, or Firm*—Harry I. Leon

(57) ABSTRACT

A pair of brackets for hanging a window blind which are both easy to install and to remove and which can be used to facilitate cleaning the blind. Each bracket includes a four-sided structure which, except for its being open on both its top and one of its vertical sides, is generally in the shape of a rectangular prism. Each bracket, which is a mirror image of the other, can be fabricated as single, unitary piece from sheet metal. Folded downwardly from the upper edge of a vertical side panel in this structure is an external flap. The bracket is installed with the use of a single screw whose shank is slip fitted into a slot formed in this flap. Since both the flap and the screw head are hidden behind the vertical side panel, neither the flap nor the screw head can interfere with the subsequent placement of a window blind mounting bar in the bracket. Alternately, prior to hanging the blind, the brackets can be held in place on the distal ends of its mounting bar; and both brackets then slip fitted simultaneously onto their respective mounting screws. To clean the blind, it and both brackets are removed as a unit and taken to a convenient outdoors location where the blind can be washed with running water. Screws or other fasteners protruding from the outside wall of a building spaced apart and oriented for receiving the brackets can be used to temporarily mount this unit and facilitate cleaning the blind.

4 Claims, 3 Drawing Sheets

REMOVABLE BLIND HANGER BRACKETS

BACKGROUND OF THE INVENTION

Installed in windows, blinds are among the first objects upon which outside dust settles; they quickly become the dirtiest parts of a room. Cleaning them is especially difficult when their hangers, as taught in the prior art, do not allow one to remove the blinds easily.

SUMMARY OF THE INVENTION

The object of the present invention is to provide a holder from which Venetian blinds and the like can be hung and from which the blinds can be easily removed.

A further object is to provide such a holder which can be installed, on a temporary basis, in a convenient location for cleaning the blinds.

A still further object is to provide a blind hanger which can be installed using only a single round head screw, a common nail or the like.

An improved blind hanger assembly comprises a pair of open-ended brackets for supporting the distal ends of a window blind mounting bar. Each bracket has a generally rectangular bottom panel and three rectangular side panels connected thereto. The side panels extend perpendicularly and upwardly from the bottom panel, forming a four-sided structure which is open on both its top and one of its vertical sides.

Folded downwardly from the upper edge of at least one of the side panels is a flap which is disposed generally back-to-back with this side panel so as to cover most of its outer surface. The flap and contiguous side panel, which are fabricated from a single piece of sheet metal, are joined only along their common upper edge and they can be spread apart slightly downwardly of this edge.

The flap itself defines an open, "L"-shaped slot which can be entered at points near a rear corner edge of the bracket. The slot is wide enough to receive the shank of a mounting screw or other fastener for securing the bracket to a window sill. At the same time, the slot is narrower than the diameter of such a fastener's head. Such a slot configuration allows one to slide the bracket rearwardly between said head and the window sill and then lower the bracket into position. Because the flap is hidden behind one of the side panels, the head of a fastener held within the slot cannot interfere with the subsequent placement of a window blind mounting bar within the bracket.

In the preferred embodiment, first and second flaps are folded downwardly from the upper edges of first and second side panels, respectively, and disposed generally back-to-back with them. Oriented perpendicularly to each other, the first and second side panels form a rear corner edge of the bracket and define a "L"-shaped slot, which extends forwardly of this corner edge, and an inverted key hole slot, respectively. The round part of the key hole slot is large enough to receive the head of a fastener, such as a mounting screw, for securing the bracket to a window sill. The narrow part of the slot is wider than the diameter of the fastener's shank but smaller than its head. Prior to use, the bracket is slid over the head of the fastener and then lowered into position. Each flap, because it is hidden behind one of the side panels, is not exposed to any component of the window blind itself, preventing interference between the fastener head which secures the flap and the window blind mounting bar.

Each bracket of the improved blind hanger assembly can be fabricated from a single piece of sheet metal, preferably of finished steel, brass or aluminum, and bent to the desired shape.

DETAILED DESCRIPTION OF THE PREFERRED EMBODIMENT

Figure 1:
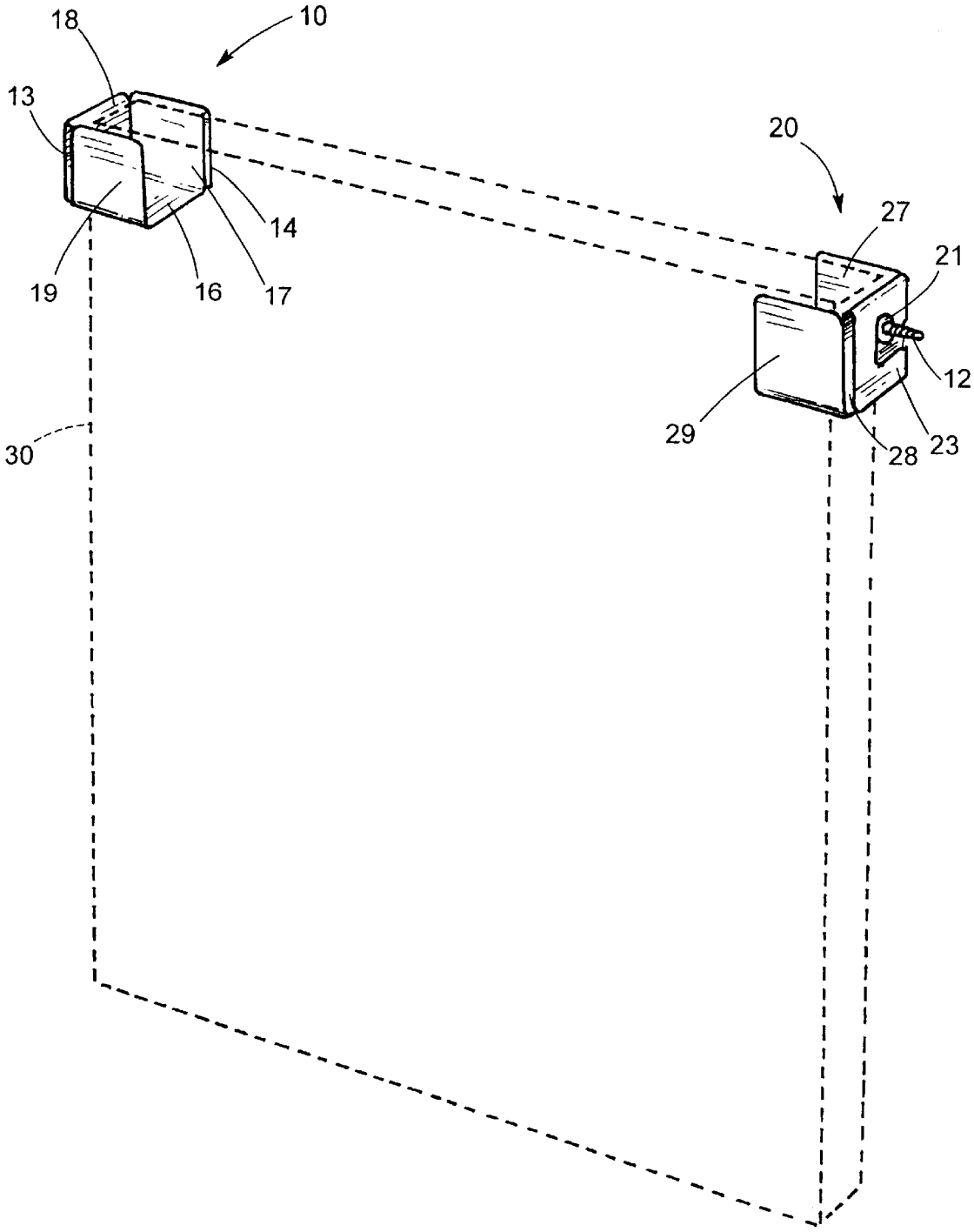
FIG. 1 is a top frontal perspective view of a pair of brackets in a blind hanger assembly according to the present invention, the brackets being spaced apart so as to support the distal ends of a window blind mounting bar, the dashed lines which show the blind being for illustrative purposes only and forming no part of the claimed invention.

As illustrated in the drawings, an improved blind hanger assembly comprises a pair of brackets 10, 20, which are mirror images of each other. Preferably fabricated as a single, unitary piece from sheet metal, each bracket 10, 20 has a generally rectangular bottom panel 16, 26 and three side panels 17, 18, 19; 27, 28, 29, respectively, connected thereto. In use, the assembly is mounted inside a window sill and fastened to opposite sides of the window opening.

Figure 2:
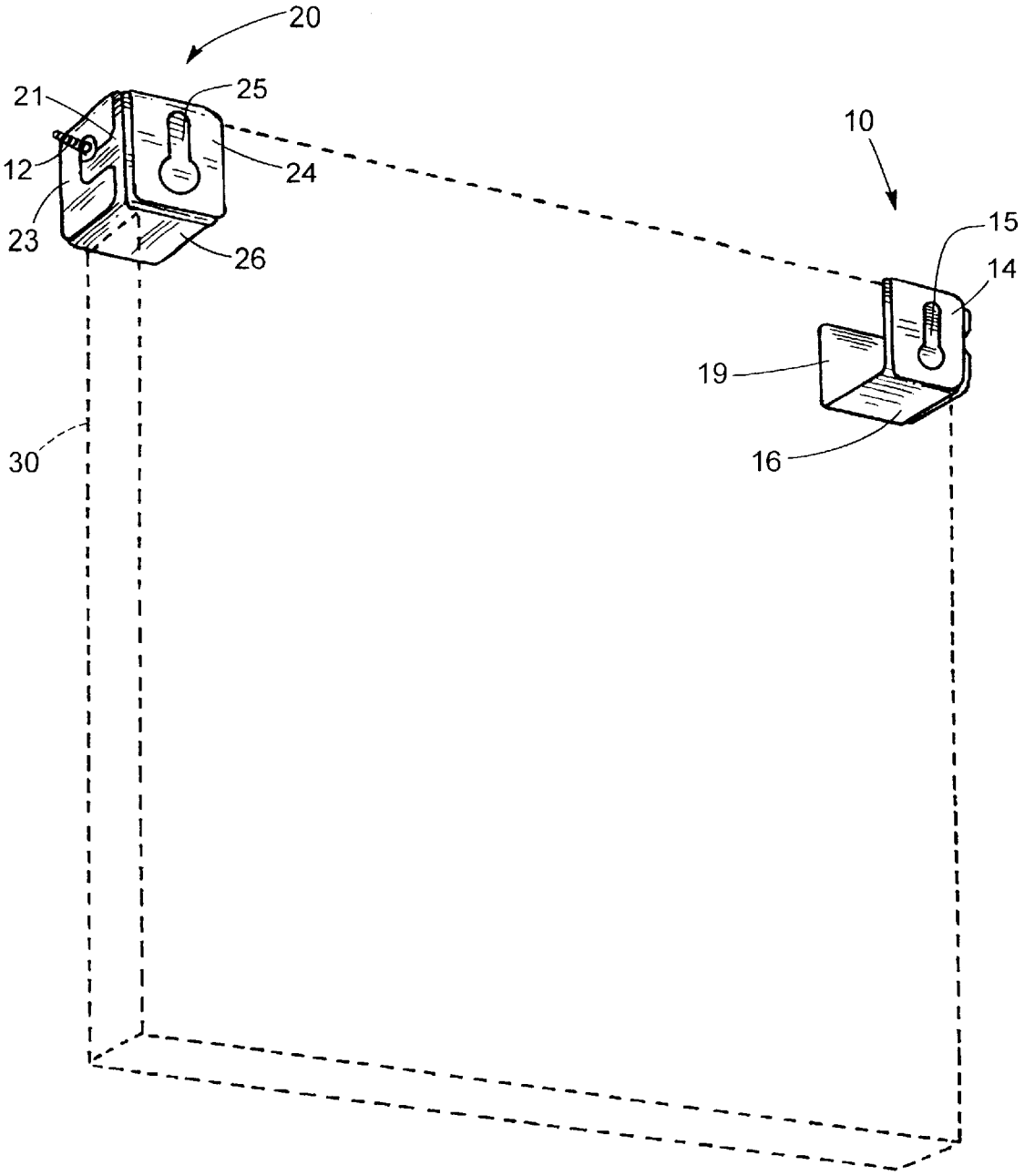
FIG. 2 is a bottom rear perspective view of the pair of brackets according to FIG. 1.
Figure 3:
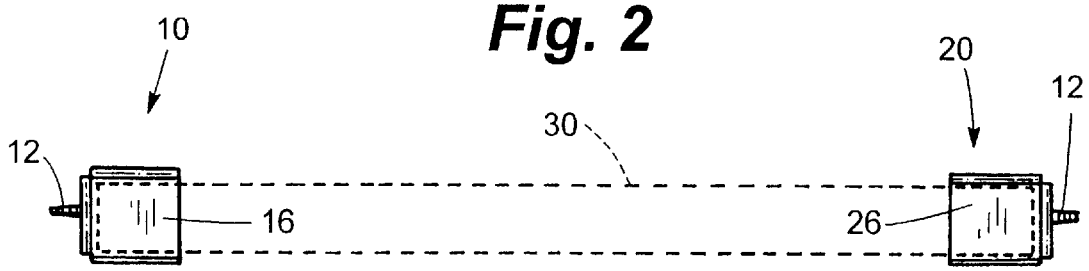
FIG. 3 is a top plan view of the pair of brackets according to FIG. 1.
Figure 4:
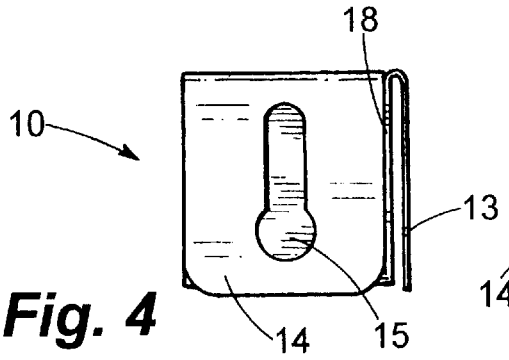
FIGS. 4 and 7 are rear elevational views of the brackets on the left and right sides, respectively, in the blind hanger assembly according to FIG. 1.
Figure 5:
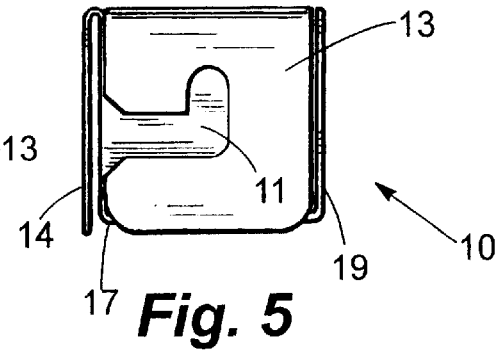
FIGS. 5 and 8 are left and right side elevational views, respectively, of the brackets on the left and right sides, respectively, in the blind hanger assembly according to FIG. 1.
Figure 7:
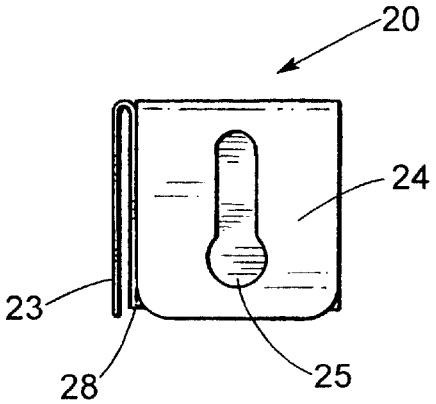
Figure 8:
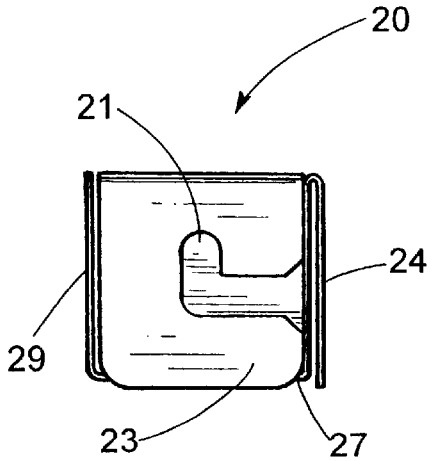

As is best illustrated in FIGS. 4, 5, 7 and 8, a flap 13, 23 is folded downwardly across the middle side panel 18, 28 in each bracket 10, 20. Open-ended, "L" shaped slots 11, 21 defined by the flaps 13, 23, respectively, are sized so that the shank, but not the head, of a fastener, such as a screw 12, can be slip fitted therein (FIGS. 1 and 2). A suitable fastener is a No. 9 round head screw which measures about 1½ inches in length. Alternately, a nail (not shown) can be used to fasten each bracket 10, 20 in place. Joined only along their common upper edge, the flap 13, 23 and contiguous side panel 18, 28 are separated slightly downwardly of this edge so that the screw head can be easily inserted between them (FIGS. 4 and 7). Moreover, with the use of the flap 13, 23, instead of the middle side panel 18, 28 itself as means for securing the bracket 10, 20 to the window sill, the screw head cannot interfere with the placement of a mounting bar of a blind 30 in the improved hanger assembly.

A preferred method of hanging a blind 30 includes the step of placing two screws 12 in the sides of a window opening so that the head of each screw protrudes from the side of the window opening a distance slightly greater than the wall thickness of the flaps 13, 23. Then as the brackets 10, 20 are being held in place on the distal ends of the top mounting bar of a blind 30, the brackets are slid, using slots 11, 21, onto the respective shanks of the screws 12.

Alternately, the blind 30 can be mounted using the inverted key hole-shaped slots 15, 25 defined by flaps 14, 24, respectively, on the back sides of rear vertical side panels 17, 27 (FIGS. 4 and 7). The slots 15, 25 are particularly useful for mounting the blind 30 and brackets 10, 20 as a unit to facilitate cleaning the blind. To utilize the slots 15, 25, the screws 12 can be located on the outside of a building near a water source and need only be installed so that they are spaced apart the same distance as they are when the distal ends of the mounting bar for the blind 30 are otherwise held within the brackets 10, 20.

For cleaning a window blind 30, it is recommended that one first raise the blind, pulling it so that it is compressed, accordion-like, into its most compact position. To remove the brackets 10, 20, one uses a two-step process: simultaneously, both of them are lifted upwardly a slight distance and then pulled straight backward from the window, thereby freeing them from the screws 12. Next the blind 30, with its mounting bar still cradled within the brackets 10, 20 is taken outside and installed temporarily on a second pair of screws 12. The latter fasteners are preferably spaced apart from and oriented relative to each other in such a way that they can be fitted into inverted key hole slots 15, 25. To clean it, the blind 30 is released and, while hanging in its fully extended position, sprayed with soap solution, rinsed with a water hose, and dried. Finally, the blind 30 is rehung on the window.

Figure 6:
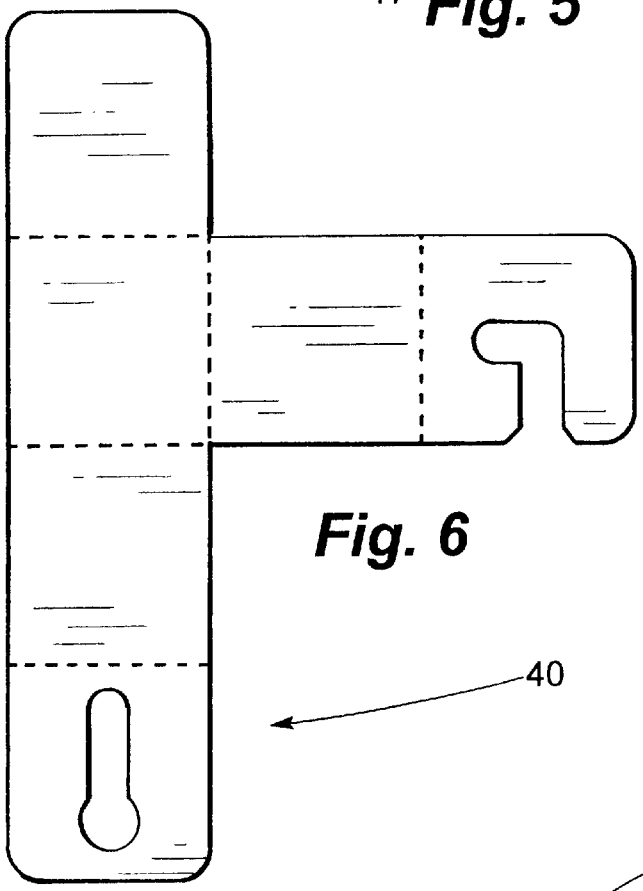
FIG. 6 is a plan view of a piece of sheet metal which has been pre-cut and is ready to be folded along the dashed lines to form either bracket in the blind hanger assembly according to FIG. 1, the bracket shown in FIGS. 4 and 5 being formed when the panels with slots are folded upwardly along the dashed lines; and the bracket shown in FIGS. 7 and 8 being formed when these same panels are folded downwardly.

Both the brackets 15, 25 can be formed from the same metal stamping 40 as shown in FIG. 6. Whether a bracket 15 or a bracket 25 is formed depends upon how the panels, delineated by dashed lines in this drawing, are bent relative to each other. Sheet metal, preferably of finished steel, brass or aluminum, is used in fabricating the brackets 15, 25.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. An assembly for hanging a window blind, comprising two brackets and two mounting fasteners, each fastener having a head and a shank; the brackets being mirror images of each other, each bracket being a single, unitary piece fabricated from sheet metal, the bracket having a generally rectangular bottom panel and three rectangular side panels connected thereto, the side panels extending perpendicularly and upwardly from the bottom panel; a first flap which is folded downwardly from the upper edge of one of the side panels, the first flap substantially covering its entire outer surface but being at least slightly separable therefrom downwardly of said upper edge; the first flap defining an elongated slot for slideably receiving the shank of one of the fasteners, so that the head thereof, when the shank is slideably received within the slot, cannot interfere with hanging the window blind from the bracket.

2. The assembly according to claim 1 wherein the elongated slot is further characterized as being open ended and "L"-shaped.

3. The assembly according to claim 1 wherein the elongated slot is further characterized as having an inverted key hole shape.

4. An assembly for hanging a window blind, comprising two brackets and at least two mounting fasteners, each fastener having a head and a shank; the brackets being mirror images of each other, each bracket being a single, unitary piece fabricated from sheet metal, the bracket having a generally rectangular bottom panel and three rectangular side panels connected thereto, the side panels extending perpendicularly and upwardly from the bottom panel; first and second flaps which are folded downwardly from two of the side panels, respectively, each flap covering substantially the entire outer surface of the side panel against which the flap is so folded and being at least slightly separable therefrom downwardly of the upper edge of the flap; the first and second flaps defining an open ended, "L"-shaped slot and an inverted key hole-shaped slot, respectively, for slideably receiving the shank of one of the fasteners, the "L"-shaped slot and the inverted key hole-shaped slot receiving said shank at intervals spaced apart in time, so that the hanger assembly can be alternately installed using the "L"-shaped slot and then the inverted key hole-shaped slot to facilitate cleaning the window blind.

* * * * *